US006504533B1

(12) United States Patent
Murayama et al.

(10) Patent No.: US 6,504,533 B1
(45) Date of Patent: Jan. 7, 2003

(54) IMAGE DISPLAY APPARATUS

(75) Inventors: Hiroshi Murayama, Kanagawa (JP); Tadashi Fujimoto, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/551,175

(22) Filed: Apr. 17, 2000

(30) Foreign Application Priority Data

Apr. 19, 1999 (JP) ..... 11-111098

(51) Int. Cl.[7] ..... G09G 3/36

(52) U.S. Cl. ..... 345/204; 345/87; 345/98; 345/99; 345/213; 345/214; 345/698

(58) Field of Search ..... 345/98, 99, 87, 345/100, 204, 213, 214, 698

(56) References Cited

U.S. PATENT DOCUMENTS 4,825,289 A * 4/1989 Ohta ..... 348/622
5,083,214 A * 1/1992 Knowles ..... 358/403
5,748,167 A * 5/1998 Watanabe et al. ..... 345/98
5,872,864 A * 2/1999 Imade et al. ..... 382/156
5,933,196 A * 8/1999 Hatano et al. ..... 348/441
5,986,635 A * 11/1999 Naka et al. ..... 345/716

FOREIGN PATENT DOCUMENTS

| | | |
|---|---|---|
| EP | 0 854 466 A1 | 7/1998 |
| JP | 10 091127 | 4/1998 |
| JP | 10 091134 | 4/1998 |

* cited by examiner

*Primary Examiner*—Bipin Shalwala
*Assistant Examiner*—Vincent E. Kovalick
(74) *Attorney, Agent, or Firm*—Frommer Lawrence & Haug LLP; William S. Frommer; Bruno Polito

(57) ABSTRACT

An image display apparatus capable of displaying an image signal of an unknown type. Characteristics of an input image signal are examined and, based on the examined characteristics, an attempt is made to identify the input signal as one of a known type. When the input signal can be identified as one of a known type, the signal is converted into a form suitable for display based on retrieved parameters corresponding to the signal's type. When the input signal can not be identified as one of a known type, the number of vertical lines in the signal is multiplied by a predetermined constant and the resulting product is used to convert the signal into a form suitable for display.

8 Claims, 4 Drawing Sheets

IMAGE DISPLAY APPARATUS

BACKGROUND OF THE INVENTION

1. Field of the Invention

The present invention relates to an image display apparatus of a dot matrix type, such as a liquid crystal display, which is capable of suitably displaying any format of Image signal which is input.

2. Description of the Related Art

Conventionally, raster scan type CRTs have been widely used for image displays for computers. This CRT display receives from a computer a video signal including an analog video signal containing a vertical synchronization signal and horizontal synchronization signal mixed together to display a desired image.

Also, recently, displays using liquid crystal panels (LCD) have come under attention from the viewpoints of space-saving, energy-saving, lower costs, etc. A liquid crystal panel is a display of a dot matrix type wherein pixels are of a fixed size and each pixel is supplied with voltage separately to separately control them for the display.

There are many types of video signals depending on the resolution, input frequency, etc. For example, as the resolution, there are 640×480 (horizontal pixels×vertical pixels (same below)), 720×400, 800×600, 1024×768, 1152×864, 1280×1024, etc. Furthermore, even among signals of the same resolution of 1280×1024, there are a large number of frequencies of signals, such as 64 kHz/60 Hz (horizontal frequency/vertical frequency (same below)), 80 kHz/75 Hz, 91 kHz/85 Hz, 81 kHz/77 Hz, etc.

For the specifications of these video signals, those established by the Video Electronics Standard Association (VESA) are widely known.

Although there are many types of video signals as explained above, many computer displays recently used are so-called "multi-sync" types, that is, are not limited to the type of video signal and are capable of automatically handling a plurality of types of video signals and suitably displaying the image.

A multi-sync type display is ordinarily designed to detect characteristics relating to specifications of a video signal, such as the state of a synchronization signal, from an input video signal, compare the characteristics with the specifications of video signals registered in advance to identify the type of the video signal, adjust a drive cycle and amplitude of scanning lines of the display so as to match with a synchronization signal of the video signal based on the identified results, and display an image in accordance with the video signal.

However, an unregistered type of video signal is sometimes input to a multi-sync display handling a plurality of types of video signals by this method.

In such a case, up until now, the method has been taken of selecting the video signal of the closest specifications among the registered video signals and controlling the display circuit based on the specifications of that video signal or of preparing default data and controlling the display circuit by using the default data when there is no matching video signal.

Also, the VESA has established a method of determining a signal timing of a not registered signal as the GTF (generalized timing formula). The method of controlling the display circuit based on this method is also being taken.

To display an analog image signal on a display of a dot matrix type, the input image signal has to be sampled at predetermined sampling intervals to convert it from an analog to digital format and made to match with the number of horizontal and vertical pixels of the display. If the number of pixels matches and the pixels are properly controlled, basically there will be almost no effect due to the differences of displays and a stable output can be expected. If the number of horizontal and vertical pixels do not match between the signal and the display, however, proper display is no longer possible.

Note that the information on the dot intervals in the horizontal direction of image signals for such a signal conversion is called a "dot clock". This information is also included in the VESA standard. In a CRT or raster scan type display, however, display is possible even without knowing the precise number of dots in the horizontal direction. Therefore, this is a parameter which is not ordinarily used for display.

In a dot matrix type multi-sync display, an image sometimes cannot be properly displayed by the conventional method of processing explained above when a non-registered video signal is input.

In the method of using the specifications of the video signal having the closest specifications to the characteristics of the detected input signal, the disadvantages sometimes arise that a signal is processed as a signal having a different resolution (number of valid pixels) just because the horizontal and vertical frequencies happen to be close, that there is no registered signal of a close frequency, the signal is processed as a signal having a little distant frequency, and the position of the image shifts, or that the scaling rate is not suitable and therefore the image overflows from the screen or conversely becomes remarkably smaller than the screen.

Further, in the method of using default data, the method works well when the signal is close to the default data, but when this is not so, the signal sometimes will not match it at all and proper display will not be possible.

Also, the GTF only establishes the time and does not include information of the dot clock frequency, so while it is useful in determining operations of a deflection circuit of the CRT, in a dot matrix type display handling fixed pixels such as a liquid crystal display, efficient information cannot be obtained and proper display is similarly not possible.

SUMMARY OF THE INVENTION

An object of the present invention is to provide a dot matrix type image display apparatus capable of properly displaying an image even if a non-registered image signal is input.

To solve the above disadvantages, an image display apparatus of the present invention comprises a characteristic detection means for detecting from an input image signal predetermined characteristics regarding the specification of the image signal including at least the number of vertical lines; a horizontal pixel number estimation means for multiplying said detected number of vertical lines with a predetermined constant to calculate an estimated value of the number of horizontal pixels; an A/D conversion means for successively sampling the signal of every horizontal period of said input image signal by a sampling cycle based on the above calculated estimated value of the number of the horizontal pixels and converting it into a digital image signal; a signal conversion means for converting said converted digital image signal to a display signal of a predetermined dot matrix type based on the configuration of a display means; and a display means of a dot matrix type for displaying the image based on the converted display signal.

In an image display apparatus having such a configuration, the characteristic detection means finds the number of vertical lines from the input image signal and the horizontal pixel number estimation means multiplies the found number of the vertical lines by a predetermined constant to estimate the number of horizontal pixels. Then, the A/D conversion means successively samples the signal at every horizontal period of the input image signal by a predetermined sampling cycle determined based on the estimated value of the number of horizontal pixels and converts it from an analog to digital format. The signal conversion means converts the thus generated digital image signal is converted to a display signal of a predetermined dot matrix type based on the configuration of the display means and displays it by the display means.

Preferably, the image display apparatus of the present invention further comprises a memory means in which information regarding specifications of said image signal including the number of horizontal pixels are stored for each of any plurality of types of image signals and an image signal identification means for comparing said detected predetermined characteristics with said information of image signals stored in advance to search for the same type of image signal as said input image signal from the plurality of types of image signals whose information is stored in advance; wherein said A/D conversion means performs said sampling by a sampling cycle based on said information regarding the number of horizontal pixels of the image signals stored in said memory means when an image signal of the same type as said input image signal is found and performs said sampling by a sampling cycle based on an estimated value of said calculated number of horizontal pixels when an image signal of the same type as said input image signal is not found.

Specifically, said horizontal pixel number estimation means multiplies said detected number of vertical lines with a predetermined constant between 1.6 to 1.85 when said input image signal is an image signal suitable to a display having an aspect ratio of 4:3; multiplies said detected number of vertical lines with a predetermined constant between 1.5 to 1.7 when said input image signal is an image signal suitable to a display having an aspect ratio of 5:4; and multiplies said detected number of vertical lines with a predetermined constant between 1.9 to 2.1 when said input image signal is an image signal suitable to a display having an aspect ratio of 16:9 so as to calculate the estimated value of the number of horizontal pixels.

More specifically, said display means is a liquid crystal display means.

Further, preferably, said signal conversion means performs conversion of said digital image signal based on said information regarding the specifications of the image signal stored in said memory means when an image signal of the same type as said input image signal is found and obtains information regarding the specifications of the image signal based on characteristics of said detected input image signal and performs conversion of said digital image signal based on the information when an image signal of the same type as the input image signal is not found.

Specifically, said signal conversion means obtains information regarding the specifications of the image signal in accordance with the GTF (generalized timing formula) established by the VESA (Video Electronics Standard Association) based on the characteristics of said detected input image signal when an image signal of the same type as the input image signal is not found.

More specifically, said characteristic detection means detects a vertical synchronization signal and a horizontal synchronization signal from said input image signal and counts the number of horizontal synchronization signals included in a vertical synchronization period to obtain said number of vertical lines.

Alternatively, specifically, said characteristic detection means detects a vertical synchronization signal and a horizontal synchronization signal from said input image signal, finds a horizontal frequency and vertical frequency, and divides the horizontal frequency by the vertical frequency to find the number of vertical lines.

BRIEF DESCRIPTION OF THE DRAWINGS

These and other objects and features of the present invention will become clearer from the following description of the preferred embodiments given with reference to the accompanying drawings, in which.

DESCRIPTION OF THE PREFERRED EMBODIMENTS

Below, preferred embodiments will be described with reference to the accompanying drawings.

An embodiment of the present invention will be explained with reference to FIGS. 1 to 4.

In the present embodiment, the present invention will be explained by describing an example of a liquid crystal display capable of properly displaying any input video signal.

First, a method of estimation of specifications of an unknown video signal used in the liquid crystal display of the present embodiment will be explained.

As explained above, when displaying a conventional analog video signal on a dot matrix type display such as a liquid crystal display panel, it is necessary to properly sample the video data for each horizontal period for each correct pixel included in that horizontal period. Information of the number of dots in the horizontal period, that is, dot clock information, becomes necessary for this.

However, the number of dots in a horizontal period is unnecessary information for a raster scan type display and is not able to be detected only by observing the signal. Also, generally, since it does not have any direct relationship with the horizontal synchronization frequency, it was unable to be obtained unless information was given separately.

However, when investigating the relationship between the number of vertical lines and the number of dots in a horizontal period for various video signals, it was found that there was a correlation between the two.

The main specification data of the video signals VGA, SVGA, XGA, and SXGA and the ratios of the total number of pixels in the horizontal direction to the total number of lines in the vertical direction are shown in Table 1.

TABLE 1

| Type | VGA | SVGA | XGA | SXGA |
|---|---|---|---|---|
| H resolution | 640 | 800 | 1024 | 1280 |
| V resolution | 480 | 600 | 768 | 1024 |
| Fh | 375 | 469 | 600 | 640 |
| Fv | 7499 | 7500 | 7503 | 6002 |
| H_TOTAL_DOT | 840 | 1056 | 1312 | 1688 |
| H_FP | 16 | 16 | 16 | 48 |
| H_SBP | 184 | 240 | 272 | 360 |
| V_TOTAL_LINE | 500 | 625 | 800 | 1066 |
| V_FP | 1 | 1 | 1 | 1 |
| V_SBP | 19 | 24 | 31 | 41 |
| Ratio of Number of HV Pixels | 1.68 | 1.6896 | 1.64 | 1.583 |

Note that the ratio of the total number of the HV pixels in Table 1 is obtained from the total number of pixels in the horizontal direction (H_TOTAL_DOT)/total number of lines in the vertical direction (V_TOTAL_LINE).

Figure 1:
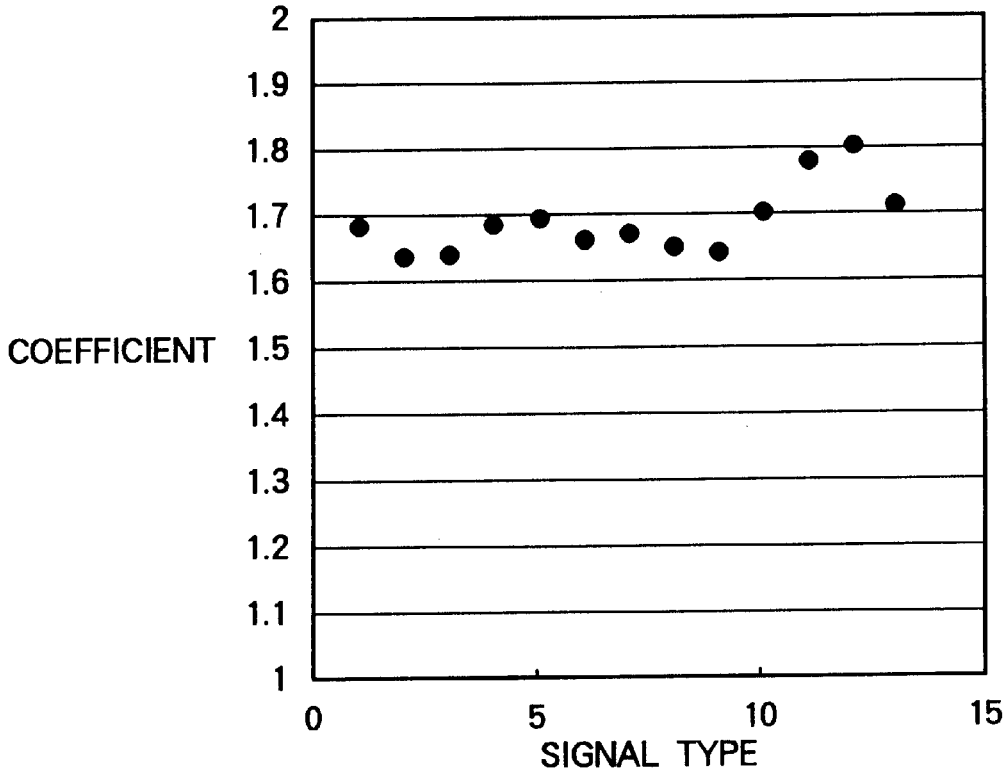
FIG. 1 is a view of the relationship of the number of vertical lines and the number of dots in a horizontal period in an image signal having an aspect ratio of 4:3.

The relationship of the number of vertical lines and the number of dots in a horizontal period of a video signal having an aspect ratio of 4:3, which includes the VGA, SVGA, and XGA shown in Table 1, is shown in FIG. 1.

As shown in the figure, the number of dots in the horizontal period becomes a value of the number of vertical lines multiplied by 1.6 to 1.85 or multiplied by about an average 1.7.

Similarly, in a video signal suitable for a display of another aspect ratio, for example in a video signal having an aspect ratio of 5:4, which includes the SXGA shown in Table 1, the number of dots in a horizontal period becomes a value of the number of vertical lines multiplied by 1.5 to 1.7 or by about an average 1.6, while in a video signal having an aspect ratio of 16:9, the number of dots in a horizontal period is the number of vertical lines multiplied by 1.9 to 2.1 or multiplied by about an average 2.0.

By using this relationship, the number of dots in a horizontal period can be estimated from the information of the number of vertical lines.

The information of the number of vertical lines is obtained easily from a video signal, so the dot clock information is to be able to be estimated by observing the input video signal without any other information.

A liquid crystal display 10 of the present invention is designed to estimate the dot clock information of any input video signal by using the method of estimation of the specifications of a video signal according to the present invention, to properly convert the video signal to a display signal of a dot matrix type, and to properly display the input video signal.

The liquid crystal display 10 of the present embodiment will be explained below.

Figure 2:
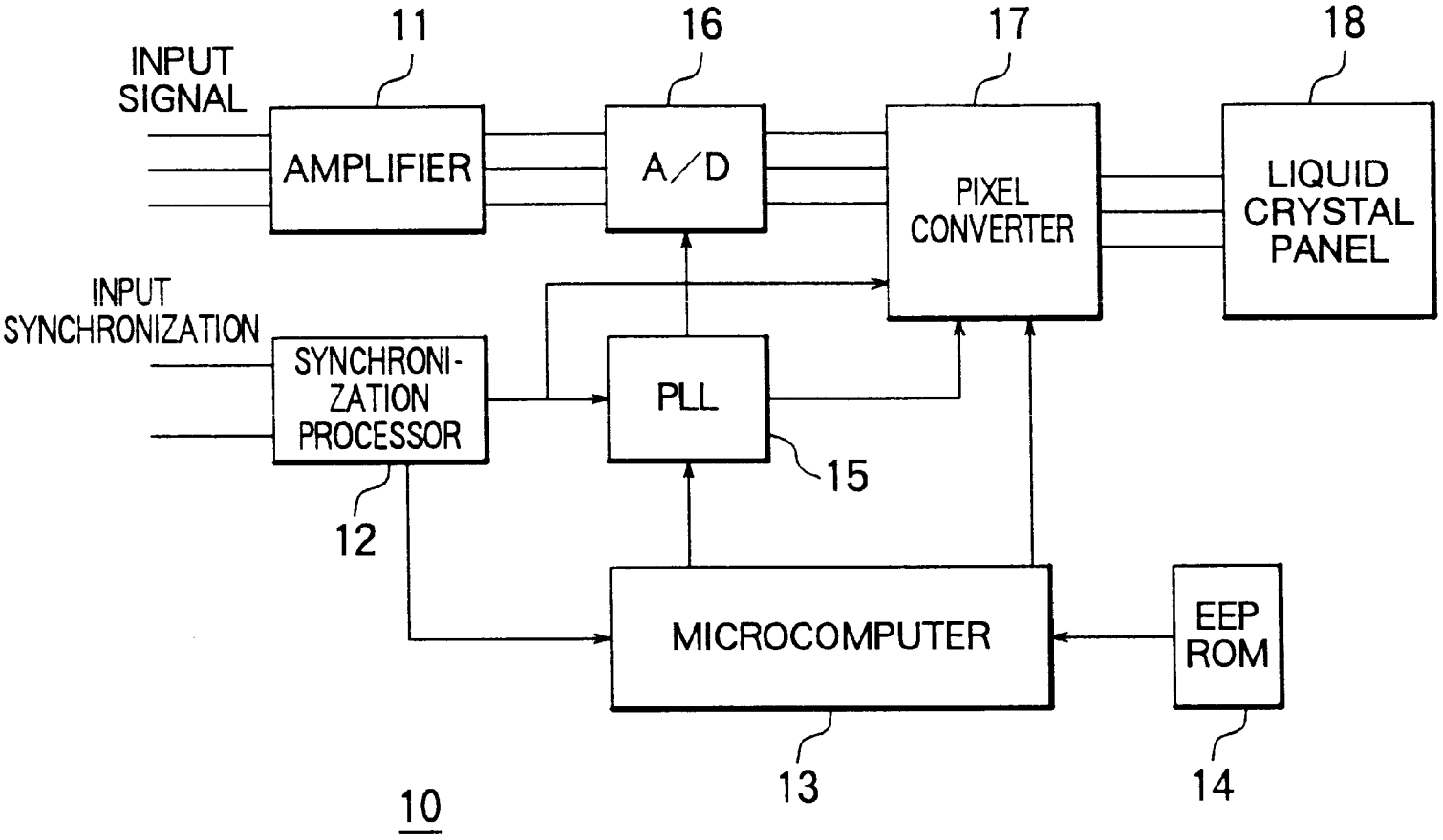
FIG. 2 is a block diagram of the configuration of a liquid crystal display of an embodiment of the present invention.

FIG. 2 is a block diagram of the configuration of the liquid crystal display 10.

The liquid crystal display 10 comprises an amplifier 11, a synchronization processor 12, a microcomputer 13, an EEPROM 14, a PLL circuit 15, an analog/digital (A/D) converter 16, a pixel converter 17, and a liquid crystal panel 18.

First, the configurations and functions of the parts of the liquid crystal display 10 will be explained.

The amplifier 11 amplifies an input video signal by a predetermined amplifying rate and outputs it to the A/D converter 16.

The synchronization processor 12 shapes the waveform of a synchronization signal of the input video signal and outputs it to the microcomputer 13, PLL circuit 15, and pixel converter 17.

The microcomputer 13 identifies the type of the input video signal based on the synchronization signal of the video signal input from the synchronization processor 12, sets control parameters for the PLL circuit 15 and the pixel converter 17 so that the PLL circuit 15 and the pixel converter 17 operate under suitable conditions in accordance with the identified video signal, and controls the operations. At this time, the microcomputer 13 refers to correction data stored in the EEPROM 14 to set the final control parameters. When the type of the input video signal is not able to be identified, the microcomputer 13 determines the control parameters by a method according to the present invention which will be explained later on and controls the PLL circuit 15 and the pixel converter 17 by this in the same way.

Note that the control parameter set in the PLL circuit 15 by the microcomputer 13 is specifically the number of dot clocks included in a horizontal period of the video signal. The microcomputer 13 sets the same as a frequency division rate to the PLL circuit 15. Also, the control parameters set in the pixel converter 17 are the number of horizontal valid pixels, the number of vertical valid lines, and the number of dots and the number of lines before a signal starts.

The microcomputer 13 will be explained in further detail with reference to FIG. 3 and FIG. 4.

Figure 3:
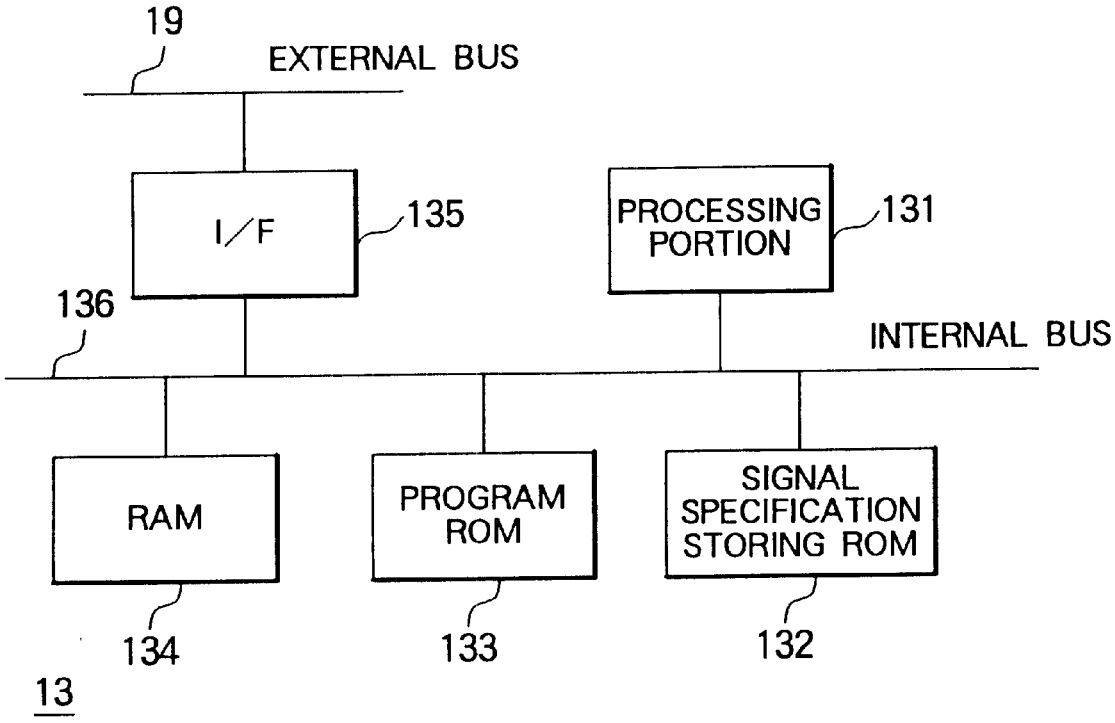
FIG. 3 is a block diagram of the microcomputer of the liquid crystal display shown in FIG. 2.

FIG. 3 is a block diagram of the microcomputer 13.

As shown in FIG. 3, the microcomputer 13 comprises a processing portion 131, a signal specification storing ROM 132, a program ROM 133, a RAM 134, an interface (I/F) portion 135, and an internal bus 136.

Note the microcomputer 13 is formed on single semiconductor integrated circuit (IC) as a one-chip microcomputer.

First, the configuration of the parts of the microcomputer will be explained.

The processing portion 131 operates based on a program stored in the program ROM 133 and performs processing for controlling the PLL circuit 15 and the pixel converter 17 based on a synchronization signal input from the synchronization processor 12 as explained above.

The detailed contents and operations of the processing portion 131 will be explained later on as the operation of the microcomputer 13.

The signal specification storing ROM 132 is a memory portion storing a horizontal frequency, a vertical frequency, a polarity of a horizontal synchronization signal, a polarity of a vertical synchronization signal, the total number of dots in the horizontal direction, a front porch in the horizontal direction, a back porch in the horizontal direction, the number of lines in the vertical direction, a front porch in the vertical direction, a back porch in the vertical direction, the number of horizontal valid pixels, and the number of vertical valid lines of all video signals which may be input to the liquid crystal display 10. The data stored in the signal specification storing ROM 132 is suitably read by the processing portion 131.

Note that the data stored in the signal specification storing ROM 132 is in the video signal format established by the VESA.

The signal specification storing ROM 132 is formed on an IC in the form of a mask ROM.

The program ROM 133 is a memory portion storing a program of the processing of the processing portion 131 and parameters for the processing. The contents of the program stored in the program ROM 133 will be also explained later on as the operation of the microcomputer 13.

The RAM 134 is a memory portion for temporarily storing data at the time when the program ROM 133 performs control processing on the PLL circuit 15 and the encoding processor 17 in accordance with the program stored in the program ROM 133.

The I/F portion 135 is an interface for inputting and outputting data and control orders to the microcomputer 13 comprised as a one-chip microcomputer as explained above.

The I/F portion 135 is connected to the internal bus 136 inside the microcomputer 13 and connected to the external bus 19 outside the microcomputer 13. The external bus 19 has connected to it the synchronization processor 12, the EEPROM 14, the PLL circuit 15, the pixel converter 17, etc. Information relating to the video signal from the synchronization processor 12 is input, correction data from the EEPROM 14 is read, and control parameters are output to the PLL circuit 15 and the pixel converter 17 through the I/F portion 135. Note that the data transfer rate of the external bus 19 is about 100 kbits/sec in the present embodiment.

The internal bus 136 is an internal bus of the microcomputer 13 and used for transferring data between the processing portion 131, the signal specification storing ROM 132, the program ROM 133, the RAM 134, and the I/F portion 135.

Note that data transfer inside the microcomputer via the internal bus 136 can be performed in units of bus width (for example, in units of bytes or words) at a rate of almost 10 MHZ, which is the operation clock of the microcomputer 13.

Next, the operation of the microcomputer 13 having the above configuration will be explained with reference to FIG. 4.

Figure 4:
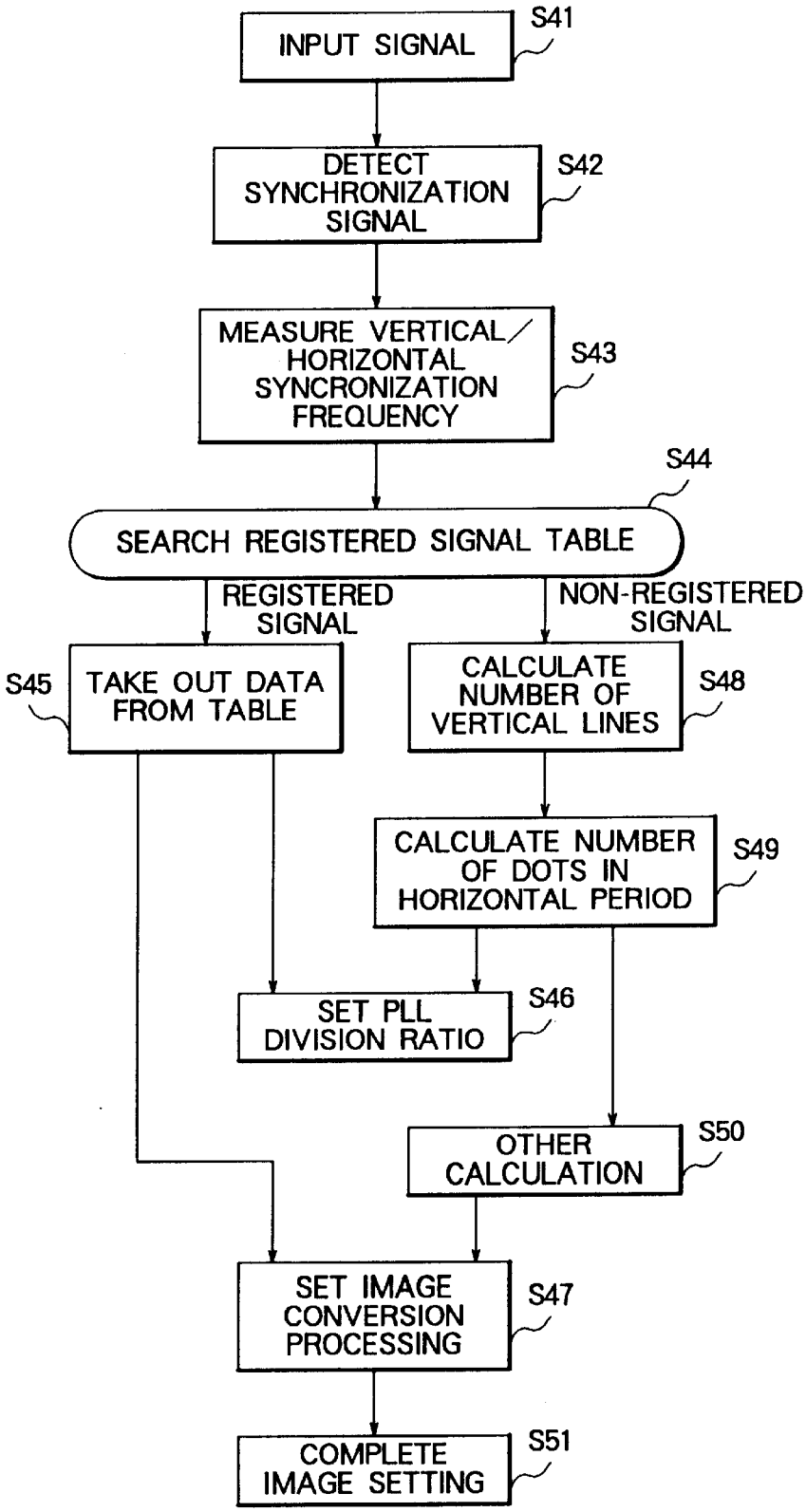
FIG. 4 is a view for explaining processing of the microcomputer shown in FIG. 3 from detection of a signal to setting of control parameters.

FIG. 4 is a flow chart for explaining the operation of the microcomputer 13, the content of the program stored in the program ROM 133, and the processing in the processing portion 13 based on the program.

When input of a synchronization signal from the synchronization processor 12 is started, the microcomputer 13 detects the same and start a series of processing (step S41).

First, the processing portion 131 waits for the input signal to stabilize and the detects a horizontal signal and a vertical signal from the input signal (step S42).

Then, based on the detected horizontal synchronization signal and vertical synchronization signal, it measures a horizontal synchronization signal frequency (also simply referred to as a horizontal frequency) and a vertical synchronization signal frequency (also simply referred to as a vertical frequency) and detects polarity information of the horizontal/vertical synchronization signals (step S43).

Then, based on the information, it searches through information relating to the specifications of signals stored in the signal specification storing ROM 132 and investigates whether there is a video signal having the same specifications as the measured and detected horizontal frequency, vertical frequency, and polarities of the horizontal/vertical synchronization signals (step S44).

When there is a video signal having the same specifications, namely, when the input video signal is a video signal registered in the signal specification storing ROM 132, further detailed information of the video signal, that is, information used for controlling the PLL circuit 15 and the pixel convertor 17, specifically, information of the number of dot clocks included in a horizontal period of the video signal, the number of horizontal valid pixels, the number of vertical valid lines, etc., is further read from the signal specification storing ROM 132. Also, simultaneously, the processing portion 131 reads correction data from the EEPROM 14 via the I/F portion 135 (step S45).

Based on the read information and the correction data, the processing portion 131 sets as a value of a division ratio the number of dot clocks included in the horizontal period to the PLL circuit 15 (step S46). Note that the relationship between the dot clocks and the division ratio is defined as formula (1).

[Formula 1]

$$\text{Dot clocks/Division ratio} = \text{Horizontal frequency} \quad (1)$$

Further, the processing portion 131 obtains the control parameters relating to pixel conversion processing such as the number of horizontal valid pixels, the number of vertical valid lines, and the number of horizontal dots and vertical lines before starting the signal, based on the read information and the correction data, and sets the parameters in the pixel convertor 17 (step S47).

As explained above, by setting the control parameters to the PLL circuit 15 and the pixel convertor 17, the control processing of the signal conversion on a series of newly input pixel signal ends (step S51).

On the other hand, at step S44, when the input video signal has not been registered in the signal specification storing ROM 132, it performs the processing according to the present invention, that is, estimates the dot clock information for the unknown signal from just the signal input from the synchronization processor 12 to obtain the control parameters for the PLL circuit 15 and the encoding processor 17.

Specifically, first, it obtains the number of vertical lines (step S48). The number of vertical lines may be obtained by counting the number of horizontal synchronization signals included in a vertical synchronization period or by dividing the horizontal frequency by the vertical frequency using the data measured in step S43.

Next, it calculates the number of dots in a horizontal period (step S49). It obtains the number of dots in a horizontal period by multiplying the number of vertical lines obtained at step S48 with a predetermined constant 1.7 as explained above with reference to FIG. 1.

Then it sets the number of dots is a horizontal period to the PLL circuit 15 as a division ratio of the PLL circuit 15 (step S46).

Next, based on the number of dots in a horizontal period and the number of vertical lines obtained in advance, it obtains the control parameters of the number of horizontal valid pixels, the number of vertical valid lines, and the number of horizontal dots and vertical lines before starting the signal from the formulas (2) to (5) by using the ratio established by the GTF (generalized timing formula) proposed by the VESA (step S50).

[Formula 2]

$$\text{Number of horizontal valid pixels} = \text{number of dots in a horizontal period} \times (0.7 + 3/\text{horizontal frequency (kHz)}) \quad (2)$$

$$\text{Number of vertical valid lines} = \text{number of vertical lines} - 0.55 \times \text{horizontal frequency (kHz)} - 1 \quad (3)$$

$$\text{Number of dots before signal starts} = \text{number of dots in horizontal period} \times (0.23 - 1.5/\text{horizontal frequency (kHz)}) \quad (4)$$

$$\text{Number of lines before signal starts} = 0.55 \times \text{horizontal frequency (kHz)} \quad (5)$$

Then, it sets the obtained parameters in the pixel converter 17 (step S47).

Also, when the input signal is unknown as well, it sets the control parameters in the above way to the PLL circuit 15 and the pixel converter 17, then ends the series of control processing for the signal conversion on the newly input signal (step S51).

The configuration and the operation of the microcomputer 13 were as explained above.

An explanation of the configuration of the different parts of the liquid crystal display 10 will follow.

The EEPROM 14 is a memory portion for storing correction data for proper display on the liquid crystal panel 18 set in consideration of an input delay of the video signal, a circuit delay of the synchronization processor 12, etc.

Since the amount of correction by the delay changes by the frequency, the measured data of a delay error in accordance with the frequency of the video signal to be displayed on the liquid crystal display 10 is written in the EEPROM 14. Note that the error is measured and the correction data is written, for example, in an adjustment process after substantial production of the liquid crystal display 10 is completed.

The PLL circuit 15 generates a predetermined clock based on the control parameter set by the microcomputer 13 and outputs it to the A/D converter 16 and the pixel converter 17. The clock generated by the PLL circuit 15 corresponds to the dot clock in the horizontal direction of the input video signal.

The A/D converter 16 successively performs sampling on the video signal input from the amplifier 11 in synchronization with the clock input from the PLL circuit 15, generates a digital signal by A/D conversion, and outputs the same to the pixel converter 17.

The pixel convertor 17 converts the input video signal based on a predetermined specification input from the A/D converter 16 to a signal having suitable specifications for displaying an image on the liquid crystal panel 18 based on the control parameters of the number of horizontal valid pixels, the number of vertical valid lines, and the number of horizontal dots and vertical lines before starting the signal and outputs the same to the liquid crystal panel 18.

The liquid crystal panel 18 is a dot matrix type liquid crystal panel and displays the video signal input from the pixel converter 17.

Next, the operation of the liquid crystal display 10 will be explained all together.

The synchronization signal of the input video signal input to the synchronization processor 12 is waveform-shaped by the synchronization processor 12 and input to the microcomputer 13.

The microcomputer 13 detects the horizontal synchronization signal and the vertical synchronization signal from the signal input from the synchronization processor 12 and, based thereon, extracts characteristic information indicating the specifications of the input video signal, such as information of the horizontal frequency, vertical frequency, and polarity of the horizontal/vertical synchronization signals.

Then, it compares the extracted information with the information of the specifications of video signals for display on the liquid crystal display 10 registered in the signal specification storing ROM 132 and identifies the type of the input video signal.

When the type of the input video signal is identified, it reads out information regarding the control of the signal from the signal specification storing ROM 132, reads the correction data such as a circuit delay stored in the EEPROM 14, and determines control parameters for the PLL circuit 15 and the pixel converter 17 based on the information and the correction data for controlling them.

Specifically, it sets a division ratio for the PLL circuit in order to generate a clock corresponding to the dot clock of the input video signal. Also, it sets a parameter regarding pixel conversion for the pixel converter 17 so that the input video signal and the pixels on the liquid crystal panel 18 properly correspond and that the signal is properly converted.

When the microcomputer 13 cannot identify the type of the input video signal, namely, when the input video signal is a not registered signal, it estimates the number of vertical lines multiplied with by predetermined constant 1.7 as the number of dots in a horizontal period, namely, the dot clock information, uses this to find information regarding the specifications of the image signal successively by a method based on the GTF. Then, it determines control parameters based on this and controls the PLL circuit 15 and the pixel converter 17.

The video signal input to the liquid crystal display 10 in a state where the PLL circuit 15 and the pixel converter 17 are set in the above way is amplified by a predetermined amplifying rate in the amplifier 11 and is properly sampled in the horizontal direction by a sampling clock synchronized with the dot clock and converted to a digital signal in the A/D converter 16. Then, it is converted to a signal for every pixel in a format suitable for display on the liquid crystal panel 18 and is applied to the liquid crystal panel 18 and displayed based on the input video signal.

As explained above, in the liquid crystal display 10 of the present embodiment, even if the input video signal is an unknown image signal which is not registered, dot clock information is estimated based on information of the number of vertical lines detectable from the input signal and control parameters for controlling the PLL circuit 15 and the pixel converter 17 are determined based on the estimated value for the control. Accordingly, it is possible to properly control the parts and to properly display the image even for such an unknown image signal.

Also, since the liquid crystal display 10 is capable of properly displaying such an unknown image signal, it is not necessary to register all image signals and therefore the types of the image signals to be registered can be reduced. Therefore, the capacity of the signal specification storing ROM 132 can be made smaller and it becomes possible to produce a more inexpensive liquid crystal display 10. Furthermore, since it is unnecessary to perform a comparison with a large amount of registered information, processing for identifying the type of the image signal and setting the control parameters can be performed at a high speed and therefore the microcomputer 13 can be substituted by more inexpensive one.

On the other hand, however, the liquid crystal display 10 has the specifications of the image signals registered in a mask ROM form in the signal specification storing ROM 132 in the microcomputer 13. Therefore, even if the amount of registered information becomes large, it can be recorded in the microcomputer 13. As a result, it is possible to make the memory cost per bit very low. Also, since high speed accessing is possible, even if the types and information amount of the image signals increase, a video signal can be identified at a high speed.

Furthermore, fine corrections relating to a circuit delay etc. can be reflected in the control by storing the data in the EEPROM 14, so a better display is guaranteed.

Note that the present invention is not limited to the above embodiments. A variety of modification can be made.

For example, in the present embodiment, the number of vertical lines multiplied by 1.7 was estimated as the dot clock value for an unknown video signal, but the constant is not limited to 1.7. When the aspect ratio is 4:3, as explained above with reference to FIG. 1, it is preferable to use a value between 1.6 and 1.85. The constant 1.7 cannot be used for signals having different aspect ratios. However, it is sufficient to use another constant suited to the aspect ratio, thus, it is clear that the case of estimating a dot clock value using such a constant is within the scope of the present invention.

Also, in the present embodiment, information of a horizontal frequency, vertical frequency, and polarity of horizontal/vertical synchronization signals was extracted from the input image signal and compared with information of specifications of video signals registered in advance so as to identify the type of the input image signal. However, the information used for the comparison is not limited to the information of a horizontal frequency, vertical frequency, and polarity of horizontal/vertical synchronization signals. Any information regarding standards or specifications of the image signal may be used.

Also, in the liquid crystal display 10, information regarding the specifications of registered video signals was stored in the signal specification storing ROM 132 and the correction data was stored in the EEPROM 14, but the configuration of the memory portion for storing the information and the data is not limited to the above and may be any configuration. For example, all the information and data may be stored in the EEPROM 14.

Other than the above, the configuration of the microcomputer 13 may be freely modified.

As explained above, according to the present invention, a dot matrix type image display apparatus capable of properly displaying an image even if a non-registered image signal is input can be provided.

What is claimed is:

1. An image display apparatus, comprising:

a characteristic detection means for detecting from an input image signal predetermined characteristics regarding the specification of the image signal including at least the number of vertical lines;

a horizontal pixel number estimation means for multiplying said detected number of vertical lines with a predetermined constant to calculate an estimated value of the number of horizontal pixels;

an A/D conversion means for successively sampling the signal of every horizontal period of said input image signal by a sampling cycle based on the above calculated estimated value of the number of the horizontal pixels and converting it into a digital image signal;

a signal conversion means for converting said converted digital image signal to a display signal of a predetermined dot matrix type based on the configuration of a display means; and a display means of a dot matrix type for displaying the image based on the converted display signal;

whereby said predetermined constant corresponds to an aspect ratio of said input image signal.

2. An image display apparatus as set forth in claim 1, further comprising:

a memory means for storing information regarding specifications of said image signal including the number of horizontal pixels for each of any plurality of types of image signals and an image signal identification means for comparing said detected predetermined characteristics with said information of image signals stored in advance to search for the same type of image signal as said input image signal from the plurality of types of image signals whose information is stored in advance; and wherein said A/D conversion means performs said sampling by a sampling cycle based on said information regarding the number of horizontal pixels of the image signals stored in said memory means when an image signal of the same type as said input image signal is found and performs said sampling by a sampling cycle based on an estimated value of said calculated number of horizontal pixels when an image signal of the same type as said input image signal is not found.

3. An image display apparatus as set forth in claim 1, wherein said horizontal pixel number estimation means multiplies said detected number of vertical lines by a predetermined constant between 1.6 to 1.85 when said input image signal is an image signal suitable to a display having an aspect ratio of 4:3, multiplies said detected number of vertical lines by a predetermined constant between 1.5 to 1.7 when said input image signal is an image signal suitable to a display having an aspect ratio of 5:4, and multiplies said detected number of vertical lines by a predetermined constant between 1.9 to 2.1 when said input image signal is an image signal suitable to a display having an aspect ratio of 16:9 so as to calculate the estimated value of the number of horizontal pixels.

4. An image display apparatus as set forth in claim 3, wherein:

said signal conversion means performs conversion of said digital image signal based on said information regarding the specifications of the image signal stored in said memory means when an image signal of the same type as said input image signal is found and obtains information regarding the specifications of the image signal based on characteristics of said detected input image signal and performs conversion of said digital image signal based on the information when an image signal of the same type as the input image signal is not found.

5. An image display apparatus as set forth in claim 4, wherein said signal conversion means obtains information regarding the specifications of the image signal in accordance with the GTF (generalized timing formula) established by the VESA (Video Electronics Standard Association) based on the characteristics of said detected input image signal when an image signal of the same type as the input image signal is not found.

6. An image display apparatus as set forth in claim 4, wherein said characteristic detection means detects a vertical synchronization signal and a horizontal synchronization signal from said input image signal and counts the number of horizontal synchronization signals included in a vertical synchronization period to obtain said number of vertical lines.

7. An image display apparatus as set forth in claim 4, wherein said characteristic detection means detects a vertical synchronization signal and a horizontal synchronization signal from said input image signal, finds a horizontal frequency and vertical frequency, and divides the horizontal frequency by the vertical frequency to find the number of vertical lines.

8. An image display apparatus as set forth in claim 4, wherein said display means is a liquid crystal display means.

* * * * *